US006523948B2

(12) United States Patent
Matsumoto et al.

(10) Patent No.: US 6,523,948 B2
(45) Date of Patent: Feb. 25, 2003

(54) INK JET PRINTER AND INK JET PRINTING METHOD

(75) Inventors: Nobuo Matsumoto, Kanagawa (JP); Seiichi Inoue, Kanagawa (JP); Eiichi Kito, Kanagawa (JP); Kiyotaka Kaneko, Kanagawa (JP); Yasuyuki Hosono, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/840,979

(22) Filed: Apr. 25, 2001

(65) Prior Publication Data

US 2001/0052920 A1 Dec. 20, 2001

(30) Foreign Application Priority Data

Apr. 27, 2000 (JP) ..... 2000-128293

(51) Int. Cl.[7] ..... B41J 2/01
(52) U.S. Cl. ..... 347/102
(58) Field of Search ..... 347/102, 16, 104, 347/197, 185, 186, 187

(56) References Cited

U.S. PATENT DOCUMENTS 4,681,313 A * 7/1987 Yokovama et al. ..... 271/273
4,788,563 A * 11/1988 Omo et al. ..... 346/140
5,373,312 A * 12/1994 Fujioka et al. ..... 347/102
5,784,090 A * 7/1998 Selensky et al. ..... 347/102
5,896,154 A * 4/1999 Minati et al. ..... 347/102
6,022,104 A * 2/2000 Lin et al. ..... 347/102
6,048,059 A * 4/2000 Wafler ..... 347/102
6,219,078 B1 * 4/2001 Sawano ..... 347/187
6,332,679 B1 * 12/2001 Higuma et al. ..... 347/102
6,336,720 B1 * 1/2002 Suzuki et al. ..... 347/88
6,336,722 B1 * 1/2002 Wonton et al. ..... 347/102
6,340,225 B1 * 1/2002 Szlucha ..... 347/102
6,342,689 B1 * 1/2002 Ishigaki et al. ..... 219/216

FOREIGN PATENT DOCUMENTS

JP 8-174812 7/1996

* cited by examiner

*Primary Examiner*—Thinh Nguyen
*Assistant Examiner*—Ly T Tran
(74) *Attorney, Agent, or Firm*—McGuireWoods LLP

(57) ABSTRACT

An ink jet printer comprises at least one ink jet head, in which plural nozzles are arranged in an array in a main scan direction, and eject a droplet of ink to recording material respectively at an ejected amount according to information of an image. Feeder rollers feed the recording material relative to the ink jet head in a sub scan direction, to print the image to the recording material two-dimensionally. A thermal head includes plural heating elements arranged in an array in the main scan direction, for applying heat to the recording material respectively in a heating region. A system controller sets drying heat energy according to the ejected amount, and drives the thermal head to apply the drying heat energy to the heating region, to promote drying of the droplet in the heating region.

32 Claims, 12 Drawing Sheets

INK JET PRINTER AND INK JET PRINTING METHOD

BACKGROUND OF THE INVENTION

1. Field of the Invention

The present invention relates to an ink jet printer and ink jet printing method. More particularly, the present invention relates to an ink jet printer and ink jet printing method in which ink can be dried quickly after printing operation.

2. Description Related to the Prior Art

An ink jet printer includes an ink jet head for printing, and is either of two types including a serial printer and a line printer. The serial printer includes a head carriage for moving the ink jet head in a sub scan direction that is widthwise to a recording sheet, and includes a mechanism for feeding the recording sheet in a main scan direction crosswise to the sub scan direction. In contrast, the line printer has a feeder for feeding the recording sheet one line after another. The line printer is advantageous in printing at a high speed.

In the line printer, ink is ejected through nozzles arranged in the range of the whole width of the recording sheet. An ejected amount of the ink per unit time is considerably high unlike the serial printer in which each belt-shaped region is recorded gradually from one side to the other. The highness of the ejected amount in the ink requires very long time for drying. The ink is likely to mix between wet droplets adjacent to one another, to cause occurrence of blur and drop of chroma. If the ink deposits on a feeder roller or the like, the ink is likely to contaminate the recording sheet. It is conceivable to dry the ink by use of a drier including a fan and a heater. However, disposition of the fan and the heater causes a problem of enlarging a size of the entirety of the line printer.

Note that, in the serial printer, the belt-shaped region can be enlarged with a greater range in a main scan direction. If the belt-shaped region has a considerably great range in the main scan direction, the ejected amount of the ink becomes very high to cause the same problem as the line printer. JP-A 8-174812 discloses a line printing type of ink jet printer in which a carriage or ink jet cartridge is provided with a heating ray emitter, which dries ink droplets or preheats recording material. However, there is no known technique for raising efficiency in the operation disclosed in this document to dry ink droplets or preheat recording material

SUMMARY OF THE INVENTION

In view of the foregoing problems, an object of the present invention is to provide an ink jet printer and ink jet printing method in which ink can be dried efficiently and quickly after printing operation.

In order to achieve the above and other objects and advantages of this invention, an ink jet printer comprises at least one ink jet head, including plural nozzles arranged in an array in a main scan direction, for ejecting a droplet of ink to recording material respectively at an ejected amount according to information of an image. A moving mechanism feeds one of the recording material and the ink jet head in a sub scan direction relative to a remaining one thereof, to print the image to the recording material two-dimensionally. At least one heater includes plural heater sections arranged in an array in the main scan direction, for applying heat to the recording material respectively in a heating region. A controller sets drying heat energy according to the ejected amount, and drives the heater to apply the drying heat energy to the heating region, to promote drying of the droplet in the heating region.

The heater is operated before, during or after operation of the ink jet head.

The controller sets the drying heat energy high according to highness in the ejected amount.

The moving mechanism feeds the recording material in the sub scan direction. Each of the heater sections in the heater corresponds to M nozzles included in the ink jet head, and $M \geqq 1$.

The heater is disposed upstream from the ink jet head with reference to feeding of the recording material, and before the ink jet head operates, preheats the heating region where the droplet is ready to deposit.

In a preferred embodiment, the heater is disposed downstream from the ink jet head with reference to feeding of the recording material, and heats the droplet ejected by the ink jet head.

In another preferred embodiment, the heater heats the droplet simultaneously with ejection by the ink jet head.

The heater is disposed opposite to the ink jet head with reference to the recording material.

In a preferred embodiment, the heater is disposed close to the ink jet head with an inclination.

Furthermore, a speed signal generator generates a signal of a feeding speed at which the moving mechanism feeds the recording material. The controller sets the drying heat energy further in consideration of the feeding speed.

Furthermore, an information input unit inputs information of a recording material width of the recording material in the main scan direction. The controller designates heater sections to be driven among the heater sections in consideration of the recording material width.

The controller, if the ejected amount is equal to or lower than one reference amount, sets the drying heat energy as zero, and if the ejected amount is equal to or higher than the reference amount, sets the drying heat energy according to the ejected amount.

The heater comprises a thermal head, the plural heater sections are constituted by plural heating elements for pressurizing and heating the recording material.

Furthermore, a head shifter shifts the thermal head between a contact position and a non-contact position, wherein the thermal head, when in the contact position, contacts the recording material and is operated, and when in the non-contact position, is away from the recording material.

Furthermore, a protector belt is passed between the thermal head and the recording material, for protecting a surface of the thermal head pressurizing and heating the recording material.

The thermal head is disposed opposite to the ink jet head with reference to the recording material.

In a preferred embodiment, the heater is disposed beside the ink jet head, and directed to a recording surface where the droplet is ready to deposit.

In another preferred embodiment, the plural heater sections are constituted by plural infrared ray emitting elements for applying infrared rays to the heating region.

In another preferred embodiment, the moving mechanism is a head carriage for feeding the ink jet head in the sub scan direction to effect belt-shaped printing of the image. Furthermore, a moving mechanism moves one of the recording material and the head carriage relative to a remaining one thereof in the main scan direction by an amount of the belt-shaped printing, to record the image in a frame printing manner. The heater is secured to the head carriage beside the ink jet head.

The heater is disposed downstream from the ink jet head with reference to feeding of the head carriage, and before the ink jet head operates, preheats the heating region where the droplet is ready to deposit.

The ink jet head prints the image at a printing width of at least 80 mm in the main scan direction. The moving mechanism feeds the recording material at a feeding speed of at least 20 mm per second in the sub scan direction.

Furthermore, an information input unit inputs at least one of environmental temperature information, type information of the recording material, and thickness information of the recording material. The controller sets the drying heat energy further in consideration of at least one of the environmental temperature information, the type information and the thickness information.

According to another aspect of the invention, at least one ink jet head includes plural nozzles arranged in an array in a main scan direction, for ejecting a droplet of ink of an ultraviolet curable type to recording material respectively at an ejected amount according to information of an image. A moving mechanism feeds one of the recording material and the ink jet head in a sub scan direction relative to a remaining one thereof, to print the image to the recording material two-dimensionally. At least one ultraviolet ray emitter unit includes plural ray emitter sections arranged in an array in the main scan direction, for applying ultraviolet rays to the recording material respectively in a ray applying region. A controller sets ultraviolet ray intensity or ultraviolet ray amount according to the ejected amount, and drives the ultraviolet ray emitter unit according to the ultraviolet ray intensity or ultraviolet ray amount to cure the droplet in the ray applying region.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
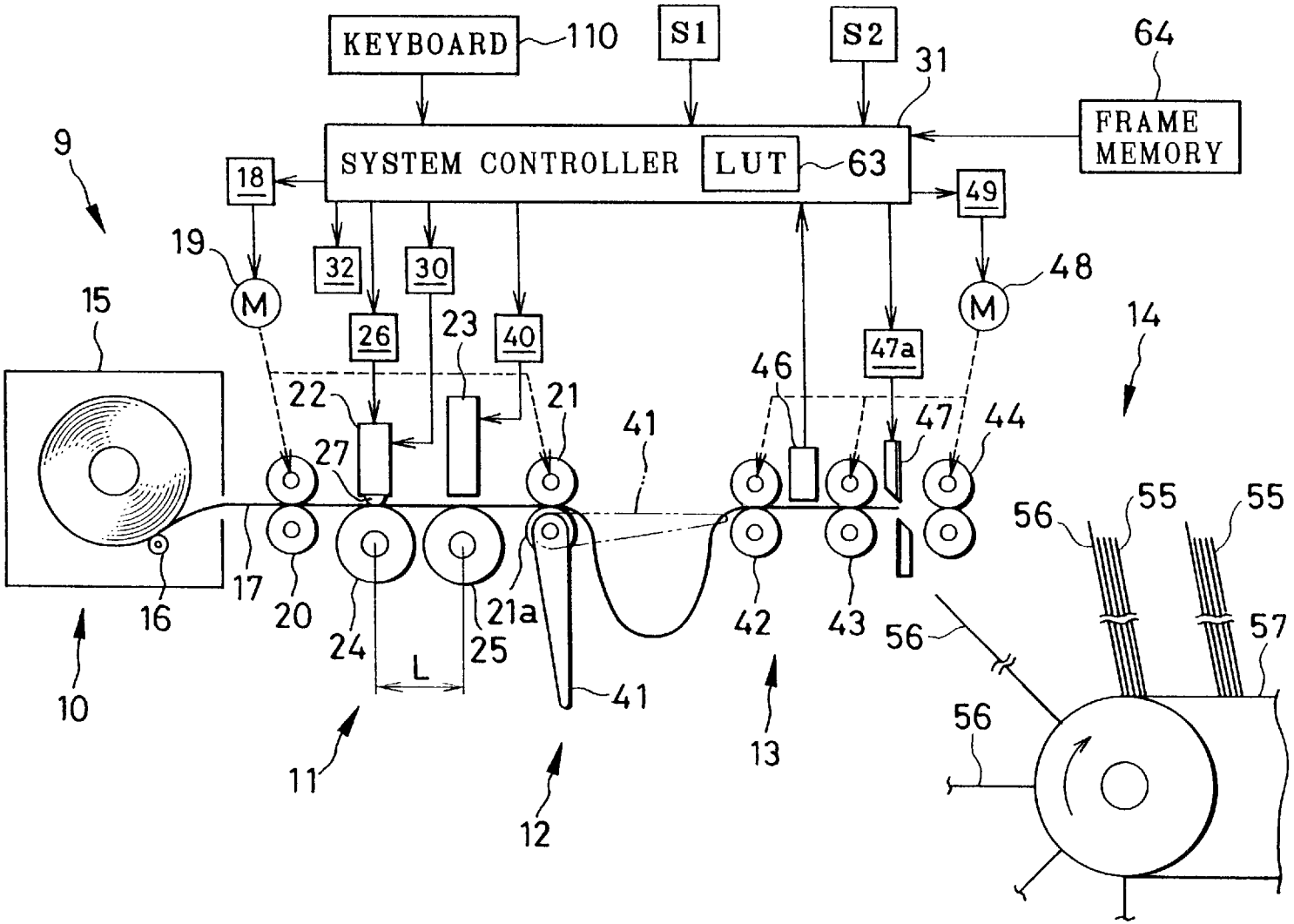
FIG. 1 is an explanatory view illustrating an ink jet printer.

In FIG. 1, an ink jet printer 9 of the invention is illustrated, and is constituted by a supply component 10, an image forming component 11, a reservoir 12, a cutter component 13 and a sorter 14. In the supply component 10, a supply roller 16 in a recording material magazine 15 is rotated, so continuous recording paper as recording material 17 is drawn out of the magazine 15. The recording material 17 being drawn is fed to the image forming component 11. In the present embodiment, the recording material 17 is 100 mm wide. An image recording region in the recording material 17 for an image frame is approximately 150 mm long, to produce prints of a post card size. Of course, the width and length of the recording material 17 may be changed in any suitable manner.

The image forming component 11 includes a first feeder roller set 20, a second feeder roller set 21, a thermal head 22 for preheating, and an ink jet head 23. A motor 19 is driven by a motor driver 18 and rotates the first and second feeder roller sets 20 and 21, which nip and feed the recording material 17. The thermal head 22 and the ink jet head 23 are disposed between the first and second feeder roller sets 20 and 21, and extend in parallel with a main scan direction that is perpendicular to feeding of the recording material 17. Platen rollers 24 and 25 are disposed under the thermal head 22 and the ink jet head 23, and support the recording material 17.

Figure 2:
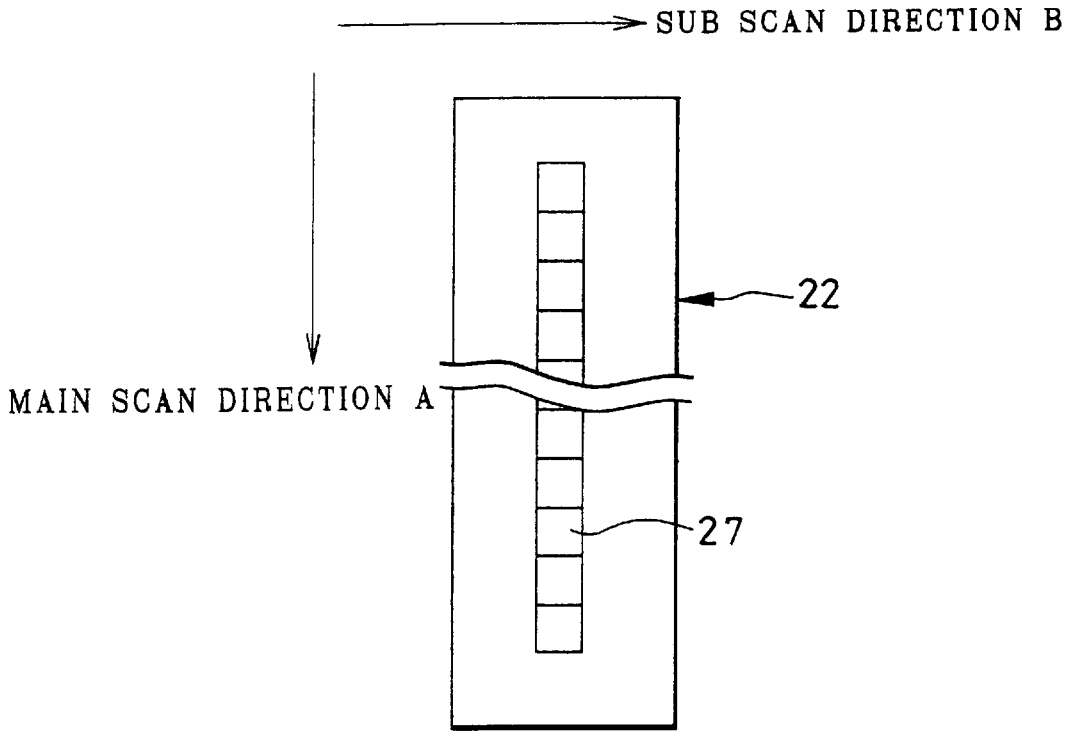
FIG. 2 is a plan illustrating a thermal head for preheating in the ink jet printer.

A head shifter 26 supports the thermal head 22 movably up and down in a vertical direction. At the recording time by use of the ink jet head 23, the thermal head 22 is moved down and squeezes the recording material 17 with the platen roller 24. Heating elements 27 as heater sections in the thermal head 22 preheat the recording material 17. At the time not of recording, the head shifter 26 sets the thermal head 22 away from the recording material 17. In FIG. 2, the heating elements 27 are disposed in the thermal head 22 in an array extending in the main scan direction A. The preheating is for the purpose of drying the ink in a short time on the recording material 17 at the time of ejecting the ink from the ink jet head 23.

In FIG. 1, a head driver 30 drives and controls the heating elements 27 in the thermal head 22. A system controller 31 sends drive data to the head driver 30, the drive data being determined for individually driving the heating elements 27. The drive data are values according to ejected amounts of ink to be ejected by the ink jet head 23. For pixels with higher ejected amounts, comparatively high preheating energy is applied to pixel regions by the heating elements 27 of the thermal head 22. For pixels with lower ejected amounts, comparatively low preheating energy is applied to pixel regions by the heating elements 27 of the thermal head 22. As will be described later in detail, the drive data for applying preheating energy are determined according to the ejected amounts of ink from the ink jet head 23.

In consideration of cooling after the preheating, it is preferable that a distance L between the thermal head 22 and the ink jet head 23 is short. According to the distance L, a position of starting the preheating of the thermal head 22 is designated in the recording material 17. Also, a position of starting the printing of the ink jet head 23 is designated in the recording material 17. The ink jet head 23 is controlled to start the printing when the printing starting position of the recording material 17 is set at the ink jet head 23.

Figure 3:
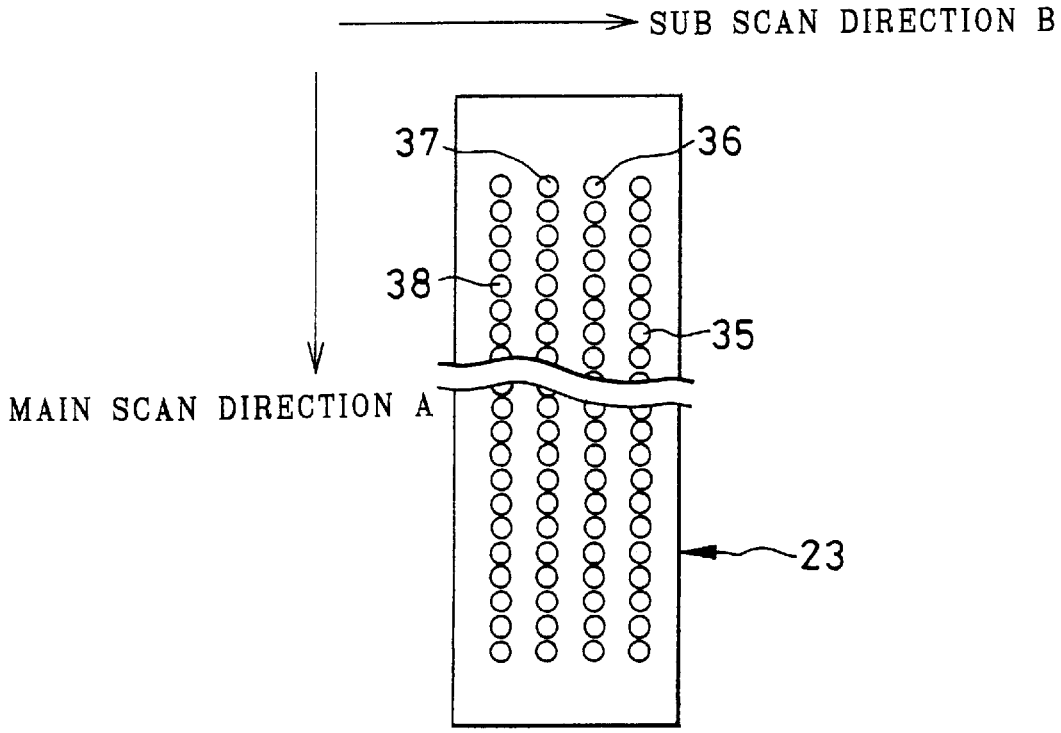
FIG. 3 is a plan illustrating an ink jet head.

In FIG. 3, the ink jet head 23 includes arrays of nozzles 35, 36, 37 and 38 for line recording of yellow, magenta, cyan and black colors, the arrays extending in the main scan direction A. The ink jet head 23 includes piezoelectric elements disposed in an ink flowing path close to the nozzles 35–38. The ink flowing path is shortened or extended by the piezoelectric elements, to eject and supply ink.

In FIG. 1, an ink jet head driver 40 sends a drive signal to each of piezoelectric elements according to image data. Ink droplets are ejected and deposited to the recording material 17 at sizes and in a number according to the image data. A full-color image is recorded to the recording material 17 with ink of yellow, magenta, cyan and black colors. Note that, according to the present embodiment, gradation is reproduced both by controlling a dot diameter and by controlling a dot density at high quality in printing. However, only one of control of a dot diameter and that of a dot density may be used. Lines to be printed are disposed at a regular pitch with reference to a sub scan direction B. The piezoelectric elements are driven for each of the colors according to image data for which positions are offset suitably. Therefore, ink droplets are provided on the recording material 17 in such a manner that each line is recorded by image data of the same image portion between the yellow, magenta, cyan and black colors.

Figure 4A:
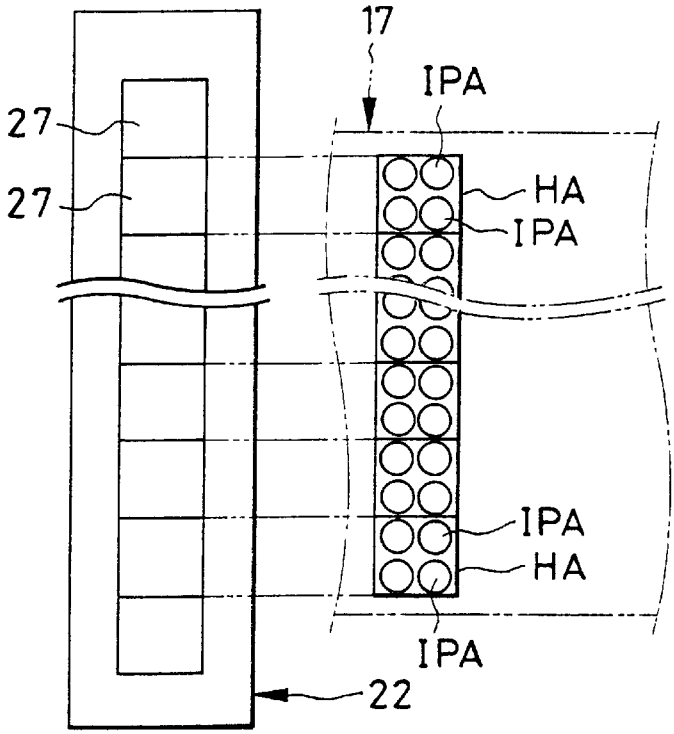
FIG. 4A is an explanatory view in plan, illustrating a relationship between the thermal head and droplets of ink.
Figure 4B:
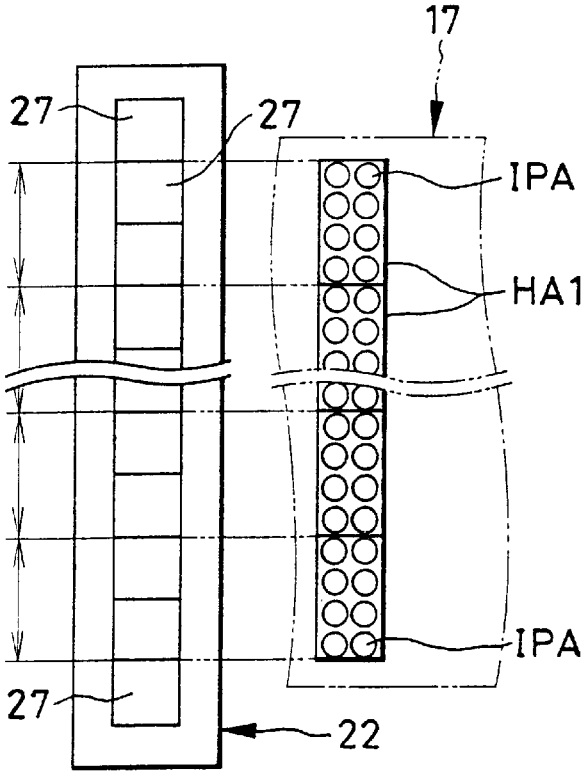
FIG. 4B is an explanatory view in plan, illustrating another preferred embodiment with a different relationship between the thermal head and droplets of ink.

FIG. 4A illustrates an example of a relationship between heating regions HA defined by the heating elements 27 in the thermal head 22 and ink ejecting regions IPA defined by the nozzles 35–38. In the present embodiment, each of the heating regions HA corresponds to a combination of four ink ejecting regions IPA disposed in a matrix of 2×2. Each of the heating regions HA is heated by one of the heating elements 27. Note that each of heating regions HA1 may be defined by a combination of two adjacent heating elements 27. Furthermore, three or more adjacent heating elements 27 may be combined to defined each one of heating regions. In the embodiments of FIGS. 4A and 4B, four or eight nozzles or ink ejecting regions IPA are combined to correspond to each one of the heating regions. However, nozzles or ink ejecting regions IPA of a suitable desired number may be combined to correspond to each one of the heating regions.

Thus, the recording material 17 is preheated by the heating elements 27 according to ejected amount for each of the heating regions HA. The ink on the recording material 17 can be dried efficiently. This is effective in suppressing decrease in chroma or definition due to mixture in ink before being dried on the recording material 17. No ink is deposited to the second feeder roller set 21. There is no contamination of the recording material 17. As the ink can be dried in a short time, it is possible to prevent partial extension of the recording material 17 due to the absorption of the ink. A succeeding line to be recorded is prevented from having corrugation. The recording material 17 is kept flat and can be used to precise printing. Heat energy of each heating element can be raised according to a rise in the ejected amount. Local extension of the recording material 17 due to deposition of ink droplets can be prevented in a manner unlike regularized heating. Also, the recording material 17 can be heated efficiently according to the ejected amount, so that the power to be used can be lowered.

In FIG. 1, the reservoir 12 includes the second feeder roller set 21, a movable guide plate 41, and a first feeder roller set 42. The second feeder roller set 21 and the movable guide plate 41 are on the side of the image forming component 11. The first feeder roller set 42 is on the side of the cutter component 13. The first feeder roller set 42 is stopped or driven at a lower speed than the second feeder roller set 21 so as to reserve a portion of the recording material 17 between the second feeder roller set 21 and the first feeder roller set 42. A lower roller 21*a* is included in the second feeder roller set 21, and has an axis about which the movable guide plate 41 is pivotally movable. The movable guide plate 41 guides a front edge of the recording material 17 toward the cutter component 13, and when the recording material 17 passes, is shifted to a guiding position indicated by the phantom lines, and after the recording material 17 passes, is shifted to a retracted position indicated by the solid lines. A portion of the recording material 17 is suspended in a space created upon movement of the movable guide plate 41, and is reserved in a temporary manner.

The cutter component 13 is constituted by the first feeder roller set 42, second and third feeder roller sets 43 and 44, an indicia sensor 46 and a cutter 47. A motor 48 causes the feeder roller sets 42–44 to rotate. A motor driver 49 is connected between the system controller 31 and the motor 48 and drives the motor 48. A cutter driver 47*a* is connected between the system controller 31 and the cutter 47 and drives the cutter 47, which cuts the recording material 17 along a borderline between image frames. A print 55 is obtained with one of image frames.

Figure 5:
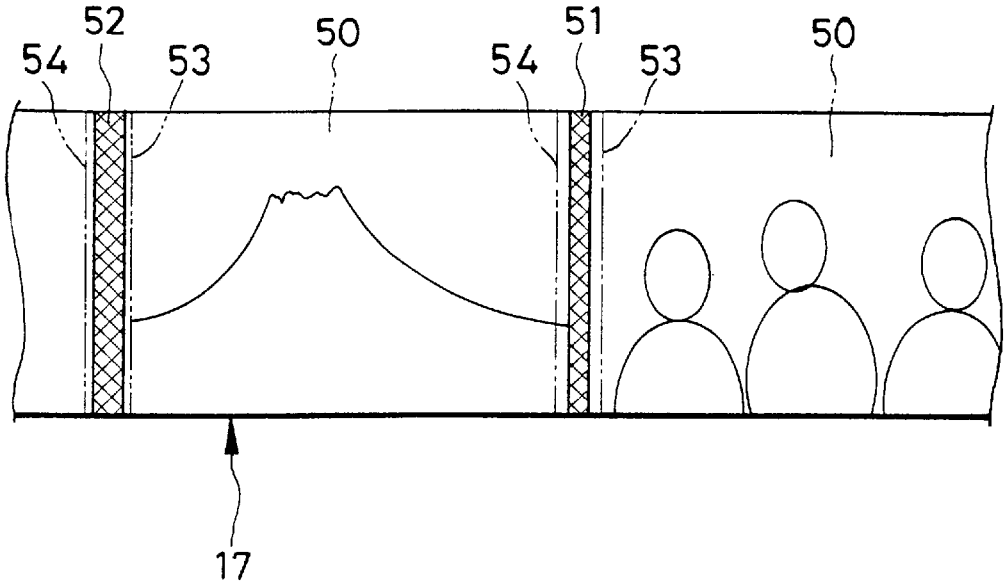
FIG. 5 is a plan illustrating a series of image frames between which indicia are printed.

A cutting indicia 51 and a sorting indicia 52 are disposed between images 50 in FIG. 5, and detected by the indicia sensor 46. In the present embodiment, the sorting indicia 52 has a size greater in the sub scan direction than the cutting indicia 51, and discernible from the same. Note that the cutting indicia 51 and the sorting indicia 52 may have a difference in appearance in any manners. For example, the cutting indicia 51 and the sorting indicia 52 may be different in the color, patterned shape, contour or the like.

The system controller 31 controls rotation of the motor 48 according to detection signals from the cutting indicia 51 and the sorting indicia 52, sets borderlines between image frames in the recording material 17 at the cutter 47. Cutting lines 53 and 54 are defined in positions downstream and upstream from the borderline, and are adapted to cutting of the recording material 17. Then portions with the cutting indicia 51 and the sorting indicia 52 are cut away to obtain the print 55 with the image 50. A print tray 56 collects a plurality of prints 55 after the cutting. Also, the system controller 31 controls the sorter 14 in response to the detection signal of the sorting indicia 52, and sets a new print tray 56 to a print dropping position. The prints 55 are respectively inserted in the single print tray 56 per each order, and collected.

In the sorter 14, a conveyor belt 57 is provided with a great number of the trays 56. Upon a signal of detection of the sorting indicia 52, the conveyor belt 57 is caused to move round by an amount of the pitch of disposition of the trays 56, one of which is thus set in the position for receiving a drop of prints.

Figure 6A:
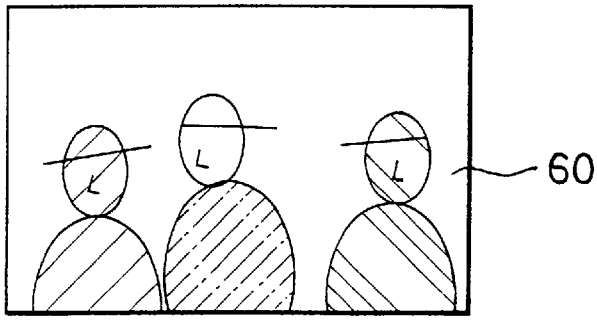
FIG. 6A is a plan illustrating a printed image.
Figure 6B:
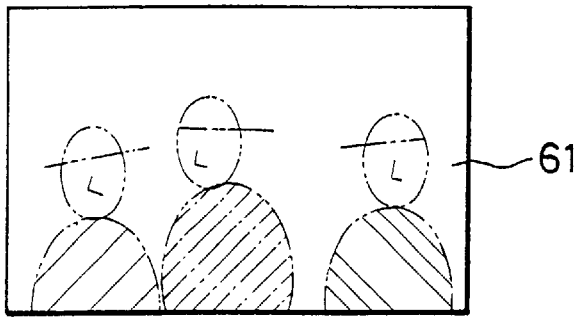
FIG. 6B is a plan illustrating a preheating pattern in relation to the printer image of FIG. 6B.

In FIG. 6A, an image 60 printed according to image data is depicted. In FIG. 6B, a preheating pattern 61 created by the thermal head 22 according to the same image data is depicted. The preheating pattern 61 is determined in consideration of the total of the ejected amounts of the yellow, magenta, cyan and black colors through the ink jet head 23 to the heating regions HA. Heat energy related to the preheating pattern 61 is determined high for each of the heating regions HA where the total of the ejected amounts is high.

Figure 7:
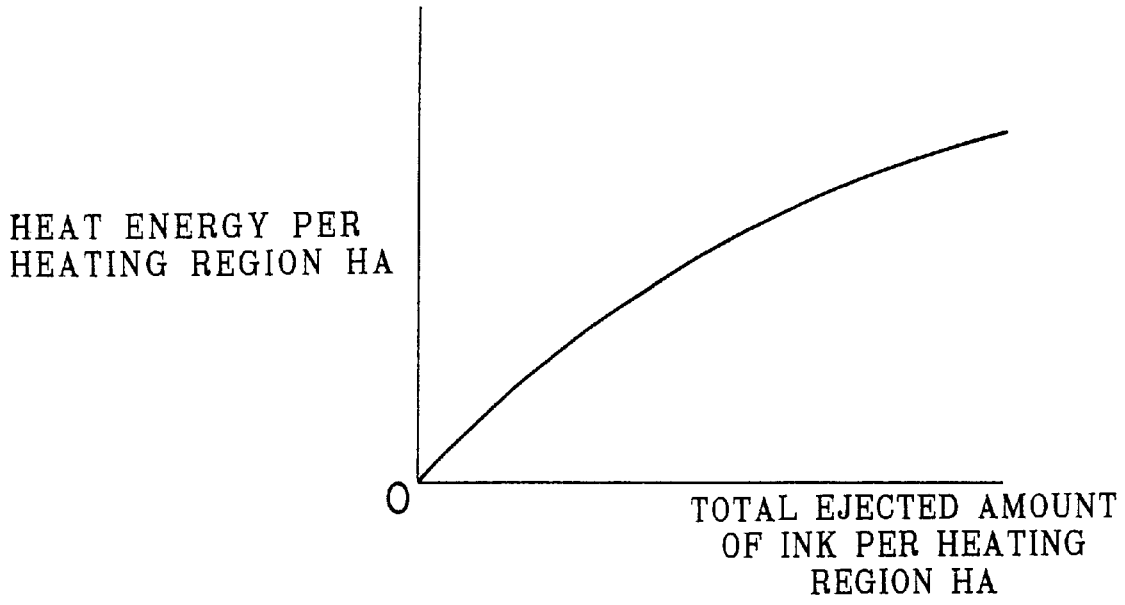
FIG. 7 is a graph illustrating a relationship between an ejected amount of ink and heat energy to be applied.

FIG. 7 is a graph indicating a relationship between a total ejected amount of ink of the heating regions HA and heat energy for the heating regions HA. The heat energy is determined the higher according to highness of the total ejected amount. The relationship is previously obtained experimentally. According to a given value of the total ejected amount, heat energy is determined by referring to the relationship in FIG. 7. Then drive data for heating elements are obtained according to the heat energy. In the present embodiment, an LUT (look-up table memory) 63 in the system controller 31 stores table data of the relationship to represent correlation between the total ejected amount and the number of drive pulses for heating elements. Note that the storage of this table data is an LUT (look-up table memory) 63*a*.

Figure 8:
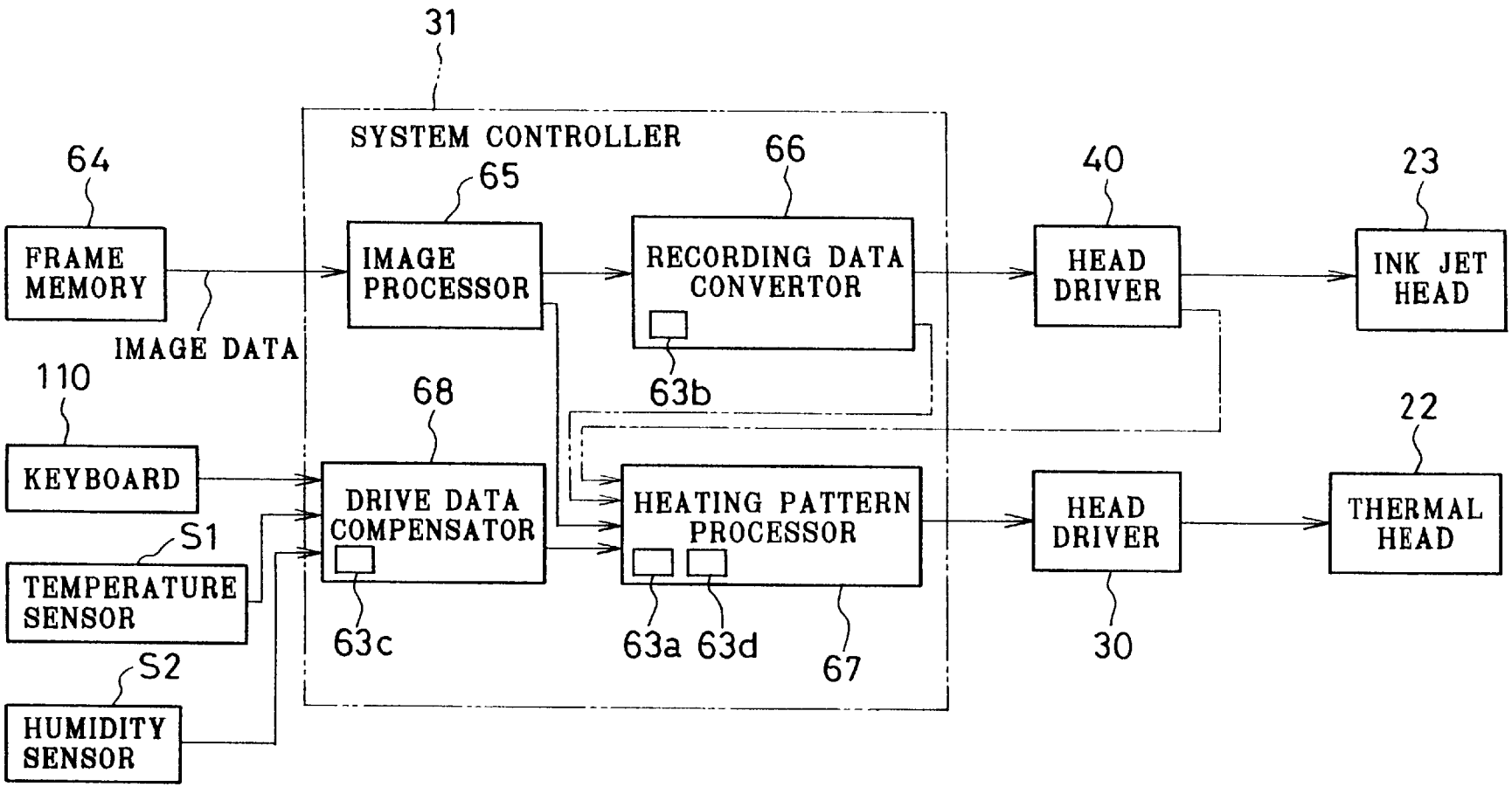
FIG. 8 is a block diagram illustrating relevant circuits in the ink jet printer.

FIG. 8 illustrates a construction for driving the thermal head 22 and the ink jet head 23 according to image data. A frame memory 64 is connected with the system controller 31. Image data from an image reader device or image output device is written to the frame memory 64.

The system controller 31 includes an image processor 65, recording data convertor 66 and a heating pattern processor 67. The image processor 65 receives image data of red, green and blue colors from the frame memory 64, and subjects those to image processing known in the art. Examples of image processing are image data designation processing for designating the entirety or part of an original image, size changing processing for changing a size of the designated region, rotation processing for rotating an image, blur processing for blurring the entirety or part of an image, sharpening processing for sharpening the entirety or part of an image, luminosity adjustment processing, contrast adjustment processing and y-value adjustment processing.

The recording data convertor 66 obtains recording data for piezoelectric elements according to image data of the red, green and blue colors after the image processing, the recording data being associated with the yellow, magenta, cyan and black colors of the nozzles 35–38 (See FIG. 3). A relationship between the image data and the recording data is previously obtained, and stored in an LUT (look-up table memory) 63*b*. The ink jet head driver 40 drives the piezoelectric elements in synchronism with feeding of the recording material 17 according to the recording data.

The heating pattern processor 67 obtains the total ejected amount for the heating region HA according to the image data. Then preheating data for the heating elements 27 in the thermal head 22 is obtained according to the total ejected amount by referring to the LUT 63*a* storing the relationship depicted in FIG. 7. The preheating data is sent to the head driver 30. The head driver 30 drives the heating elements according to the preheating data in synchronism with feeding of the recording material 17, to preheat the recording material 17 before printing of the ink jet head 23. The recording material 17 is fed to a printing position at the ink jet head 23, which prints an image to the recording material 17 in a manner coincident with the preheating pattern 61 of FIG. 6B. Note that the heating pattern processor 67 may determine preheating data according to the recording data output by the recording data convertor 66 as indicated by the phantom line in FIG. 8. Also, the heating pattern processor 67 may determine preheating data according to the drive data from the ink jet head driver 40. Furthermore, preheating data may be determined according to an amount of a volatile component of the ejected ink droplet. Also, preheating data may be determined simply according to image data without operation of obtaining an ejected amount, because there is a given relationship between the ejected amount and the image data.

In FIG. 1, a pulse generator 32 as speed signal generator is connected with the system controller 31 for detecting a feeding amount of the recording material 17. The pulse generator 32 contacts the recording material 17 and generates a number of pulses in a proportional manner to a feeding amount of the recording material 17. The system controller 31 counts the number of the pulses generated by the pulse generator 32, and obtains a feeding amount of the recording material per unit time. According to the feeding amount, the system controller 31 determines a time point of starting driving the ink jet head 23 or the thermal head 22. Also, a drive data compensator 68 in FIG. 8 compensates for drive data for the heating elements 27 according to the feeding speed of the recording material 17. For example, heat energy to be generated by the heating elements 27 is increased if the feeding speed of the recording material 17 is set higher. Heat energy to be generated by the heating elements 27 is decreased if the feeding speed of the recording material 17 is set lower. If the feeding speed of the recording material 17 is extremely small and near to zero (0), heat energy is set as zero (0) to avoid unnecessary heating of the recording material 17. An LUT (look-up table memory) 63*c* stores a correction amount for this operation. A correction amount is obtained according to the feeding speed.

The operation of the above embodiment is described. When a power source is turned on, the supply roller 16 and the feeder roller sets 20 and 21 start rotation at first. The recording material 17 is fed to the image forming component 11. The thermal head 22 is kept in the retracted position by the head shifter 26, and allows a front edge of the recording material 17 to pass. When the front edge moves past the second feeder roller set 21, then the recording material 17 is stopped and becomes ready for printing.

Then a printing key is operated to enter a signal of starting printing. The recording material 17 is fed by the first and second feeder roller sets 20 and 21. The head shifter 26 moves down the thermal head 22 and sets the same in a preheating position. Then drive data for the heating elements 27 are created according to image data. The thermal head 22 preheats the recording material 17. Also, the ink jet head driver 40 controls the nozzles 35–38 in the ink jet head 23. To a start position of the preheating pattern, the nozzles 35–38 eject ink droplets according to the image data for printing an image according to ink jet printing.

As the recording material 17 has been preheated in consideration of the total ejected amount according to the image data, ink is dried shortly once ejected to the recording material 17. Consequently, there occurs no local corrugation or other irregularity due to deposited ink along each printing line. The recording material 17 is kept flat. Printing of the ink jet head 23 can be effected with high precision. Furthermore, there is no ink stuck to the second feeder roller set 21 before being dried. There is no contamination of the recording material 17. It is possible to suppress decrease in chroma or definition due to mixture in ink before being dried on the recording material 17.

In FIG. 5, the cutting indicia 51 is printed by the ink jet head 23 on each borderline of the images 50. The sorting indicia 52 is printed by the ink jet head 23 on each borderline between groups of images 50 associated with single orders.

Therefore, a position of the borderline can be set at the cutter 47 by detecting the cutting indicia 51 with the indicia sensor 46. The portion with the cutting indicia 51 is cut away by cutting along the cutting lines 53 and 54. At the time of starting printing, the cutting indicia 51 is printed to the front edge of the image 50. A margin portion along the front edge of the recording material 17 is cut away. Upon detection of the sorting indicia 52, image frames are cut away from one another in a similar manner to the cutting indicia 51. Also, a sorting signal is generated in relation to the sorting indicia 52 for representing borderlines between orders for printing. If there is no image to be printed after printing a series of images, the front edge of the recording material 17 is moved back to the second feeder roller set 21 in the image forming component 11, and stands by for printing.

In the present embodiment, the recording material 17 is 100 mm wide. A printing region of the recording material 17 for one image frame is 150 mm long including the cutting indicia 51. A feeding speed of the recording material 17 in printing is 30 mm/sec. A printing width of the ink jet head 23 is 100 mm in one pass. In the present invention, it is possible that a printing width of the ink jet head 23 is 80 mm or more, and that a feeding speed in printing is 20 mm/sec or more. Ink can be dried rapidly without lowering the feeding speed in printing.

In the above embodiment, the number of the pixel regions IPA related to the nozzles 35–38 in the ink jet head 23 is four times as high as the number of the heating regions HA related to the heating elements 27 in the thermal head 22. See FIG. 4. However, the heating regions HA may have a size other than that according to FIG. 4. For example, the heating regions HA can be determined identical to the pixel regions IPA. This makes it possible to drive the heating elements 27 according to each of the ejected amounts from the nozzles 35–38. The preheating of the recording material 17 can be very precise.

Also, each of the heating elements may correspond to a combination of plural ink ejecting regions IPA disposed in a suitably predetermined matrix, for example 2×1, 3×2, 3×3, 4×4, 10×2 and the like. Also for such constructions, a total ejected amount is obtained for the plural nozzles associated with the heating regions. According to the total ejected amount, drive data for heating elements corresponding to the nozzles are determined. In short, the number of the heating elements 27 in the thermal head 22 is smaller than the number of the nozzles in each single array in the ink jet head 23 in relation to the nozzles 35–38. The manufacturing cost of the thermal head 22 can be lowered because of a relatively great size of the heating elements 27. This is effective in reducing a cost of the ink jet printer.

Figure 9:
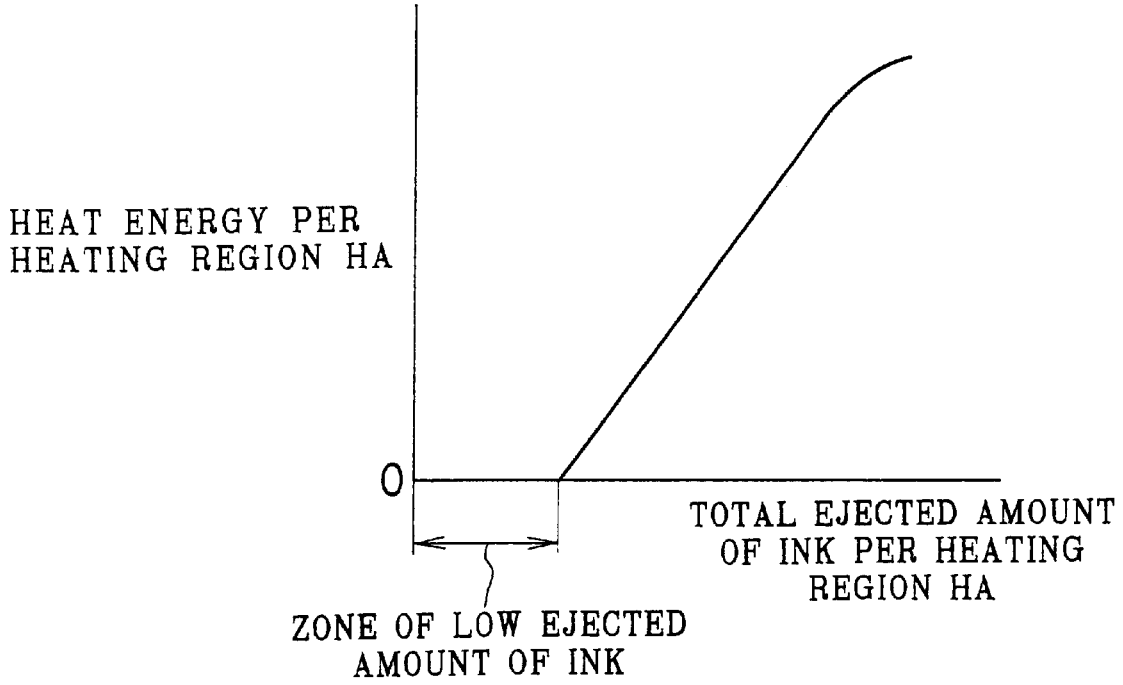
FIG. 9 is a graph illustrating another preferred embodiment with a relationship between an ejected amount of ink and heat energy to be applied.

FIG. 7 illustrates a relationship between the total ejected amount of the heating regions HA and heat energy emitted by the heating elements 27 for the heating regions HA. This is an increasing relationship between the total ejected amount and the heat energy. Furthermore, the heating elements 27 are driven even when ink of an extremely small amount is ejected. Alternatively, FIG. 9 illustrates an embodiment in which ink is naturally dried without forcible drying when ink of an extremely small amount is ejected. There is a small reference amount being predetermined. If an amount of ink is equal to or smaller than the reference amount, heat energy to be applied by the heating elements 27 is set zero (0). This is effective in reducing the total of electric power. FIG. 8 illustrates one relationship between the total ejected amount of the heating regions HA and heat energy emitted by the heating elements 27 for the heating regions HA. No heat energy is emitted if an amount of ink is equal to or smaller than the reference amount, so the use of electric power is economized. An LUT (look-up table memory) **63*d* is provided and stores the relationship between the total ejected amount and the heat energy applied by the heating elements according to FIG. 9. Drive data for each of the heating elements is obtained by referring to the 63*d***.

Figure 10A:
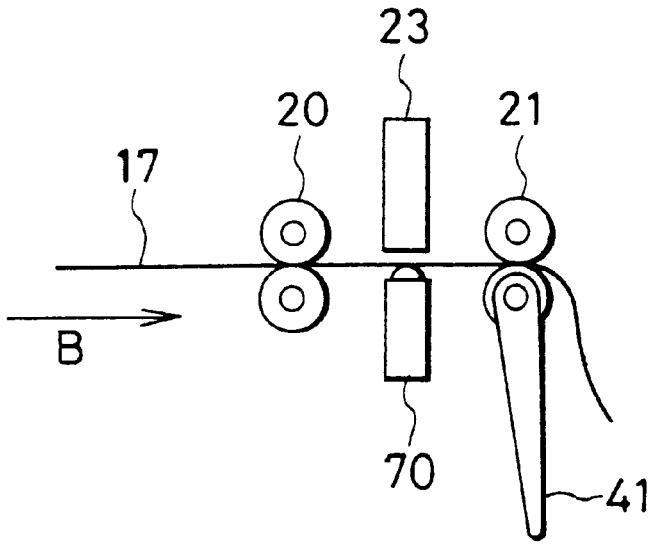
FIG. 10A is an explanatory view in elevation, illustrating a preferred embodiment in which a thermal head is opposed to the ink jet head.
Figure 10B:
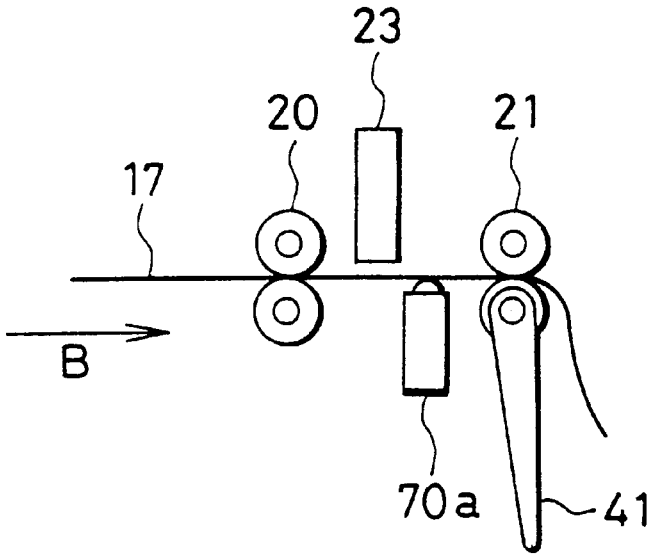
FIG. 10B is an explanatory view in elevation, illustrating a preferred embodiment in which a thermal head is positioned downstream from the ink jet head.

In the above embodiment, the thermal head 22 is positioned upstream from the ink jet head 23 with reference to feeding of the recording material 17. In FIG. 10A, another preferred embodiment is depicted, in which a thermal head 70 as a heater may be disposed directly under the ink jet head 23. The thermal head 70, for pressurization, contacts a back surface of the recording material 17 which is reverse to a recording surface for receiving ink, so as to prevent the thermal head 70 from contacting the ink before being dried. In FIG. 10B, an embodiment is illustrated, in which a thermal head **70*a* as a heater is offset from the ink jet head 23 downstream with reference to feeding of the recording material 17**. Elements similar to those of the above embodiment are designated with identical reference numerals.

Furthermore, it is possible that a thermal head as a heater may be disposed upstream from the ink jet head 23, and contacts the back surface of the recording material 17 for the purpose of preheating.

Figure 11:
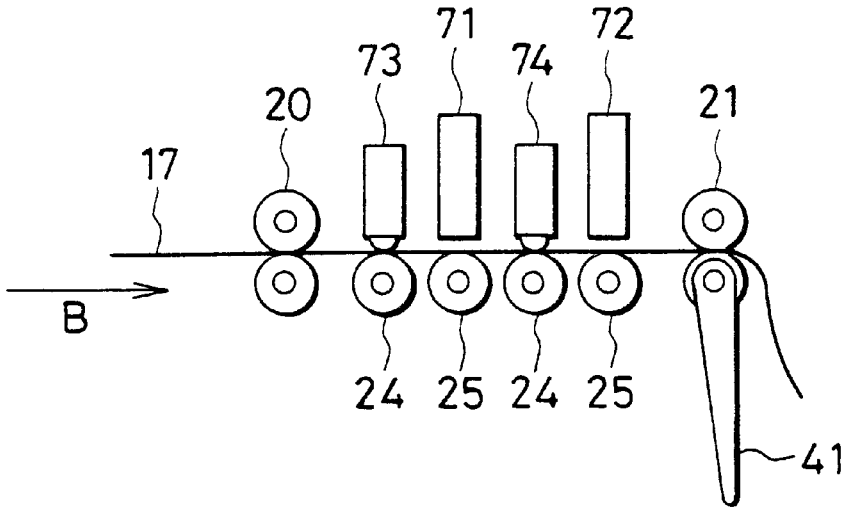
FIG. 11 is an explanatory view in elevation, illustrating another preferred embodiment having two ink jet heads.

In the above embodiment, the nozzles 35–38 for the yellow, magenta, cyan and black colors are arranged in the ink jet head 23 being single in a line shape as illustrated in FIG. 3. Furthermore, a plurality of ink jet heads may be used. In FIG. 11, a first ink jet head 71 has nozzles for ejecting black ink. A second ink jet head 72 has nozzles for ejecting yellow, magenta and cyan ink. First and second thermal heads 73 and 74 as heaters are associated with respectively the ink jet heads 71 and 72, and preheat the recording material 17 with heat energy determined according to the ejected amounts of the ink jet heads 71 and 72. Note that, for a full-color image of an ordinary image frame, an ejected amount of the black ink is smaller than those of the yellow, magenta and cyan ink. Therefore, the first ink jet head 71 is disposed upstream from the second ink jet head 72 with reference to the feeding direction. Black ink can be ejected to the recording material 17 and dried earlier than the yellow, magenta and cyan ink. The second thermal head 74 can be so disposed as to contact the recording surface of the recording material 17. This is effective in increasing efficiency in the drying operation.

Figure 12:
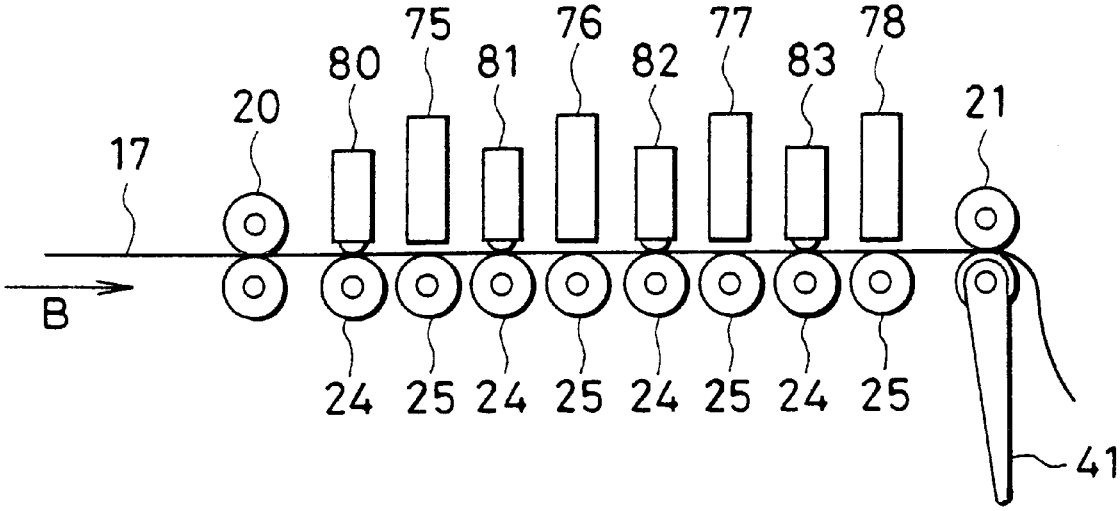
FIG. 12 is an explanatory view in elevation, illustrating another preferred embodiment having four ink jet heads.

In FIG. 12, a preferred embodiment is illustrated, in which first, second, third and fourth ink jet heads 75, 76, 77 and 78 are provided for printing of yellow, magenta, cyan and black colors. First, second, third and fourth thermal heads 80, 81, 82 and 83 as heaters are disposed upstream from respectively the four ink jet heads 75–78 for preheating the recording material 17 according to ejected amounts from the nozzles in the four ink jet heads 75–78. Also, the fourth ink jet head 78 for the black color may be positioned upstream from the first, second and third ink jet heads 75–77 in a manner similar to the positioning of the first ink jet head 71 of FIG. 11.

In the above embodiment, ink of each of the yellow, magenta, cyan, and black colors is ejected by one nozzle array in FIG. 3. Furthermore, ink of each of the yellow, magenta, cyan and black colors may be ejected by a plurality of nozzle arrays. The number of the nozzles per unit length in the main scan direction becomes lower because of the increase in the number of the arrays. This facilitates the manufacture of the ink jet heads. Furthermore, a plurality of ink jet heads having a smaller length in the main scan direction may be used. Those ink jet heads can be arranged in line and combined for printing in the full range in the main scan direction.

Figure 13:
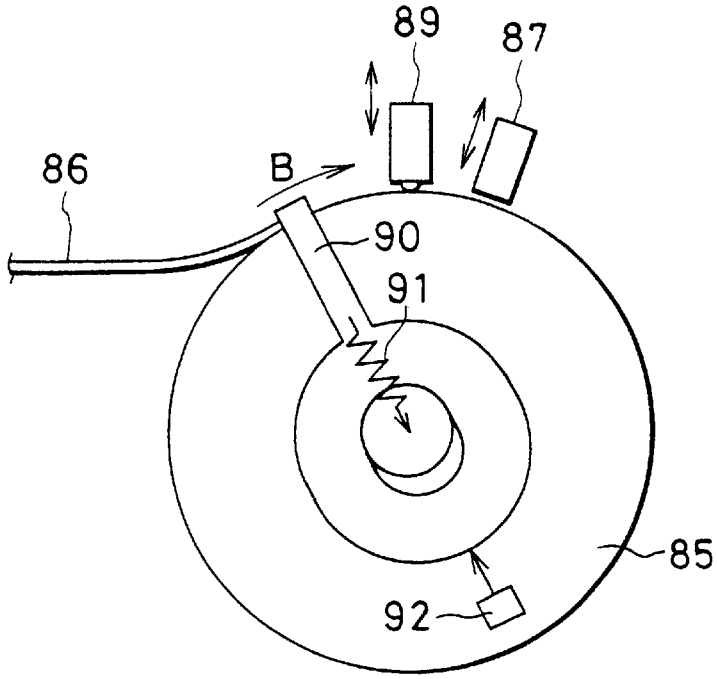
FIG. 13 is an explanatory view in elevation, illustrating another preferred embodiment having a platen drum as moving mechanism for recording material.

In the above embodiment, recording material wound in a roll form is used. Alternatively, recording sheets of a limited length may be used in an ink jet printer. Such an ink jet printer may include a platen drum. See FIG. 13. A recording sheet 86 as recording material is fitted on a periphery of a platen drum 85 as a feeder. An ink jet head 87 prints an image to the recording sheet 86. A thermal head 89 as a heater is positioned upstream from the ink jet head 87 with reference to feeding of the recording sheet 86, and preheats the recording sheet 86 according to an ejected amount.

There is a clamper 90 for retaining a front edge of the recording sheet 86 to the platen drum 85. A tension coil spring 91 biases the damper 90 in a direction to retain the front edge of the recording sheet 86 to the platen drum 85. Before squeezing the front edge of the recording sheet 86, a shifter mechanism 92 raises the damper 90. Also, shifter mechanisms (not shown) are associated with the ink jet head 87 and the thermal head 89 and shift those to prevent interference of the clamper 90 therewith. The ink jet head 87 and the thermal head 89 are shifted to their retracted positions each time that the clamper 90 moves past the ink jet head 87 and the thermal head 89. Note that, instead of the shifter mechanisms, a gap may be formed in the periphery of the platen drum 85 for containing the damper 90 for the purpose of avoiding interference of the damper 90 with the ink jet head 87 and the thermal head 89.

It is furthermore possible to consider a type, thickness and width of the recording material in compensating for drive data for heating elements. In FIG. 1, a keyboard 110 as input unit is provided and connected to the system controller 31 for inputting information of the type, thickness and width of the recording material 17. Instead of inputting with the keyboard 110, it is also possible to predetermine discernment information of the recording material 17 in a form of a bar code, and preprint the discernment information to the recording material 17 or a winding core for the recording material 17. The discernment information can be automatically read, and used for compensating for drive data of heating elements. Compensation amounts for the drive data are previously obtained experimentally, and are written to the LUT 63*c* in the drive data compensator 68 as depicted in FIG. 8. A compensation amount is obtained by referring to the LUT 63*c* and according to the discernment bar code and a signal entered by a recording material type key in the keyboard 110. Drive data is compensated for according to the compensation amount. It is also to be noted that plural operation modes can be predetermined by presetting plural combinations of a type, thickness and width of the recording material 17. Relationships between image data and preheating drive data for the heating elements can be previously obtained for each of the preset operation modes, and stored in the LUTs 63*a* and 63*d*.

Furthermore, drying speed correlated with environmental temperature or humidity may be previously obtained in view of conditions of placing the ink jet printer, so as to compensate for drive data of the heating elements. As illustrated in FIG. 1, a temperature sensor S1 and a humidity sensor S2 are provided in the ink jet printer. Output signals from the sensors S1 and S2 are input to the system controller 31. Then the drive data compensator 68 in the system controller 31 in FIG. 8 compensates for drive data to be applied to the heating elements according to the output signals. Note that, instead of compensating for the drive data, it is possible to consider the environmental temperature and humidity, previously obtain relationships between image data and drive data for the heating elements, and write those to the LUT 63*c*.

Furthermore, it is preferable to drive the heating elements selectively in a manner suitable for a width of the recording material 17. The drive data compensator 68 in FIG. 8 determines selected heating elements in the thermal head according to information of the width of the recording material 17 particularly when the recording material 17 is renewed.

Figure 14:
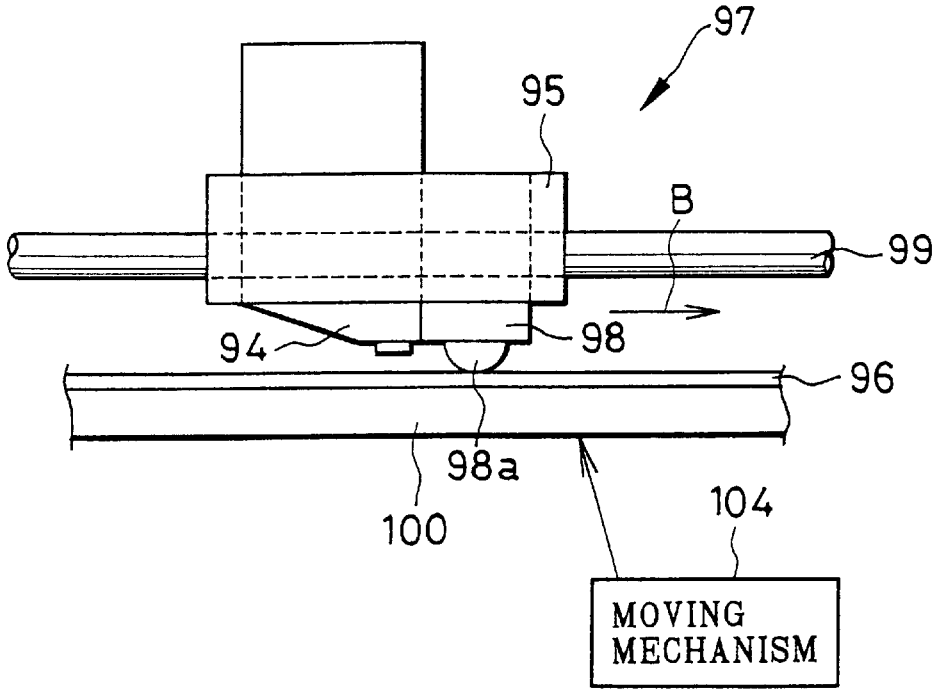
FIG. 14 is a front elevation, partially cutaway, illustrating another preferred embodiment of a serial printing type.

In the above embodiment, the printer is a line printer for recording one line after another in the main scan direction A that is widthwise of the recording material 17 and the recording sheet 86. In FIG. 14, another preferred embodiment is illustrated, in which a serial printer 97 has an ink jet head 94, and a head carriage 95 in a feeder causes the ink jet head 94 to scan recording material 96 in sub scan direction B for recording, the sub scan direction B being widthwise of the recording material 96. A thermal head 98 as a heater is disposed in a position on the head carriage 95, and located downstream from the ink jet head 94. The thermal head 98 includes heating elements 98*a* as heater sections associated with nozzles in the ink jet head 94. The heating elements 98*a* preheat the recording material 96 with energy according to ejected amounts of the respective nozzles, so as to dry ink rapidly. Note that a guide rod 99 guides the head carriage 95 in the sub scan direction B of the recording material 96. A platen 100 such as a platen drum supports the recording material 96. A moving mechanism 104 moves the platen 100 in the main scan direction A which is perpendicular to the sheet surface of the drawing.

Note that the head carriage 95 moves back and forth in the sub scan direction. While the head carriage 95 moves forwards, the ink jet head 94 operates for printing. While the head carriage 95 moves backwards, the ink jet head 94 is returned from a printing end position to a printing start position.

Figure 15:
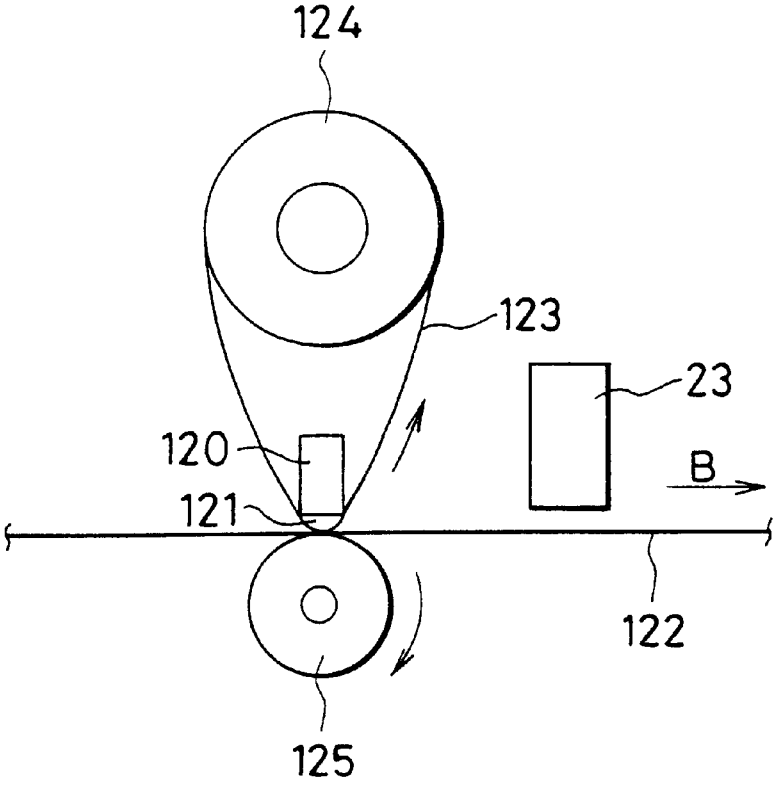
FIG. 15 is an explanatory view in elevation, illustrating another preferred embodiment including a protector belt for protecting the thermal head.

When the thermal head contacts the recording material directly, resistance to feeding of the recording material is considerably high. The thermal head is likely to be abraded. This is specifically conspicuous if minute gaps or projections are formed in the recording surface of the recording material for the purpose of efficient absorption and drying of ink. FIG. 15 illustrates a preferred embodiment in which a lifetime of a thermal head can be longer. A protector belt 123 of an endless shape is passed between recording material 122 and heating elements 121 in a thermal head 120 as a heater, and prevents the heating elements 121 from directly contacting the recording material 122.

A belt pulley 124 is disposed above the thermal head 120. The protector belt 123 is disposed to run between peripheries of the heating elements 121 and the belt pulley 124 with looseness. A width of the protector belt 123 is equal to or more than a range of all the heating elements 121 in the thermal head 120. When a platen roller 125 rotates, the protector belt 123 moves freely in response to feeding of the recording material 122. An example of the protector belt 123 is formed from polyimide or other synthetic resin, and has a thickness of approximately 50 $\mu$m. Also, the protector belt 123 can be a thin sheet formed from metal or the like, and may have a suitable thickness more or less than 50 $\mu$m. In synchronism with feeding of the recording material 122, it is possible that the belt pulley 124 drives the protector belt 123 to move around. This is effective in reducing resistance of the recording material 122 against feeding. Also, a printer may have the platen drum of FIG. 13 instead of the platen roller 125, and may be provided with the protector belt 123.

Figure 16A:
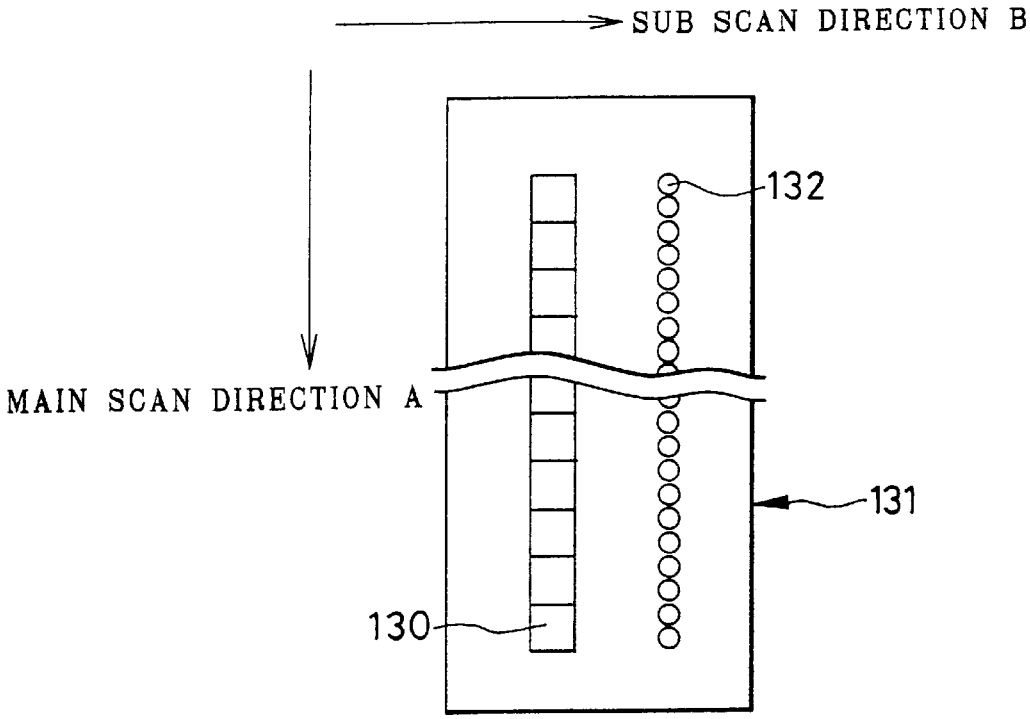
FIG. 16A is an explanatory view in plan, illustrating a preferred embodiment with the ink jet head and an array of infrared laser diodes for preheating in the ink jet printer.
Figure 16B:
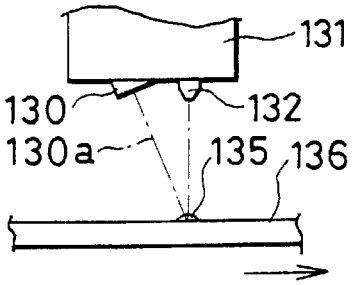
FIG. 16B is a side elevation illustrating the embodiment of FIG. 16A.
Figure 16C:
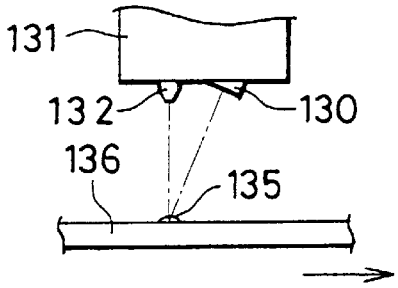
FIG. 16C is a side elevation illustrating another arrangement of an array of infrared laser diodes downstream from the ink jet head.

In FIG. 16A illustrates an ink jet head 131 including IRLDs (infrared laser diodes) 130 as heating ray emitting elements. A great number of nozzles 132 are arranged in the main scan direction in the ink jet head 131 with the IRLDs 130 in a great number. In the present embodiment, two of the nozzles 132 are associated with one of the IRLDs 130. Note that a ratio of the numbers between the nozzles 132 and the IRLDs 130 may be determined in any suitable manner. In FIG. 16B, an optical axis 130*a* of the IRLDs 130 is positioned in a direction toward recording material 136 and directed to a position for receiving an ink droplet 135. Each of the IRLDs 130 emits infrared rays to the ink droplet 135 to dry the same efficiently. In a manner the same as the heating elements 27 described above, a ray amount of the IRLDs 130 is controlled according to the ejected amount. To control the ray amount, a voltage applied to the IRLDs 130 is changed to change intensity of the rays. Also, a duty factor of a current flowing in the IRLDs 130 may be changed to change an exposure amount of rays per unit time. Note that, in FIG. 16B, the IRLDs 130 are positioned upstream from the nozzles 132 as viewed with feeding of the recording material. Furthermore, in FIG. 16C, the IRLDs 130 may be positioned downstream from the nozzles 132.

Figure 17:
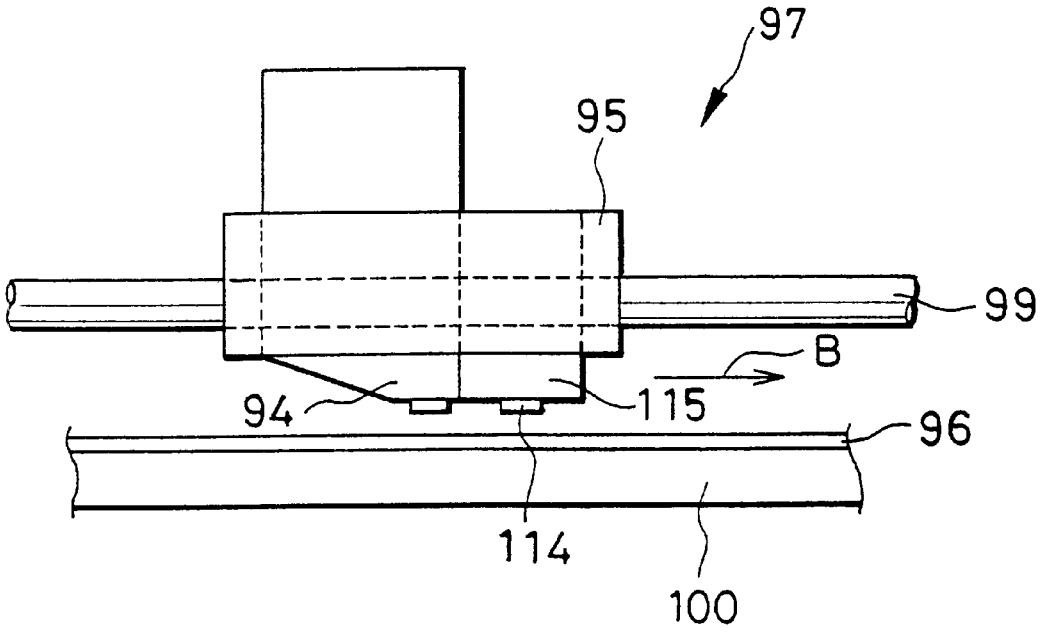
FIG. 17 is a front elevation, partially cutaway, illustrating another preferred embodiment of a serial printing type with an array of infrared laser diodes.
Figure 16D:
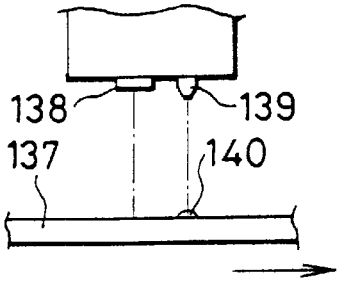
FIG. 16D is a side elevation illustrating an arrangement of an array of infrared laser diodes directed vertically to the recording material.
Figure 16E:
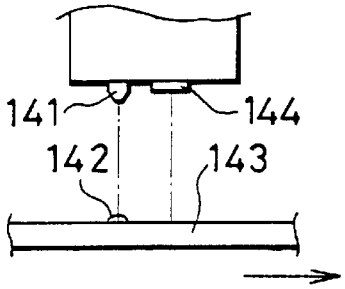
FIG. 16E is a side elevation illustrating an arrangement of an array of infrared laser diodes downstream from the ink jet head.

In FIG. 16D, IRLDs (infrared laser diodes) 138 preheat recording material 137 before printing by application of infrared rays. An ink droplet 140 is ejected by each of nozzles 139 to a printing position in a preheating pattern, and dried quickly because of the heat. In FIG. 16E, an ink droplet 142 is ejected by each of nozzles 141 to recording material 143, which is heated by infrared rays from IRLDs (infrared laser diodes) 144 for drying the ink droplet 142. Note that the structures of FIGS. 16A–16E may be incorporated in a line printing type of ink jet printer in FIGS. 1 and 10–13, and also in a serial printing type of ink jet printer in FIG. 14. In FIG. 17, a serial printing type is illustrated, and has a ray-emitting head 115 including at least one array of IRLDs (infrared laser diodes) 114. The array in the ray emitting emitting head 115 extends in parallel with nozzles 94*a* in the ink jet head 94. Note that, in FIG. 17, elements similar to those in FIG. 14 are designated with identical reference numerals.

Figure 18:
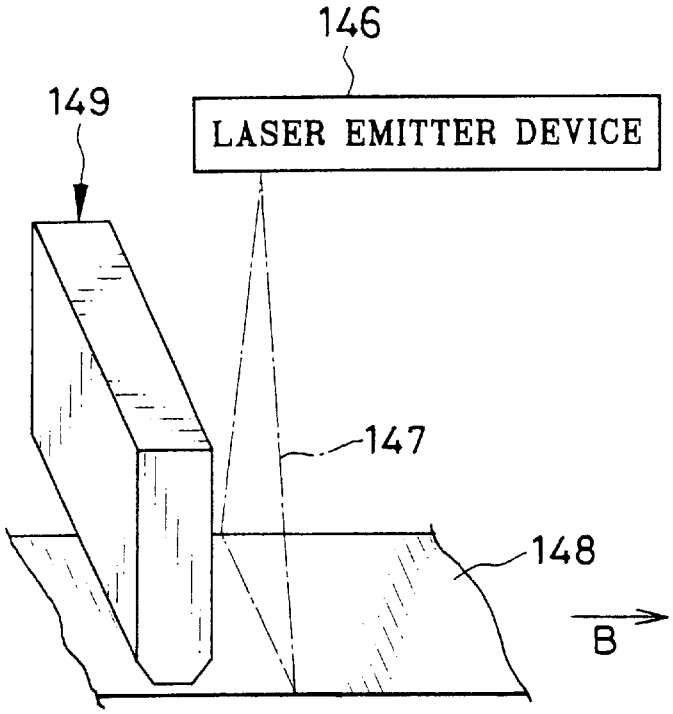
FIG. 18 is an explanatory view in perspective, illustrating a preferred embodiment having a laser emitter unit.

In FIG. 18, still another preferred embodiment is depicted, in which a laser emitter unit 146 is used to apply laser light 147 to recording material 148 for heating. Heat energy to be applied by the laser emitter unit 146 is determined according to an ejected amount. The recording material 148 may be preheated, or may be dried during or after recording. An ink jet head 149 is disposed beside the laser emitter unit 146. Intensity of the laser light 147 is changed by modulation according to the ejected amount, to apply heat energy according to the ejected amount. This is effective in efficiently drying the ink. The laser emitter unit 146 includes elements such as an fθ lens, polygon mirror and the like well-known in the art, scans the recording material 148 with the laser light 147 in the main scan direction, to preheat the recording material 148 or dry ink being ejected. It is to be noted that, a heater device may include a digital micromirror device (DMD), a piezoelectric type of micromirror device (AMA) or the like (not shown) disposed along the arrays of the nozzles of the ink jet head. Heating beams, laser light or the like is applied to the digital micromirror device (DMD) or the piezoelectric type of micromirror device (AMA), in which micromirrors are tilted individually to apply heating beams or laser light in a selective manner according to the ejected amounts.

It is also to be noted that the IRLDs 130, 138, and 144 and the laser emitter unit 146 may be disposed on a side opposite to the ink jet head with respect to the recording material, and apply heat to the back surface of the recording material.

Figure 19:
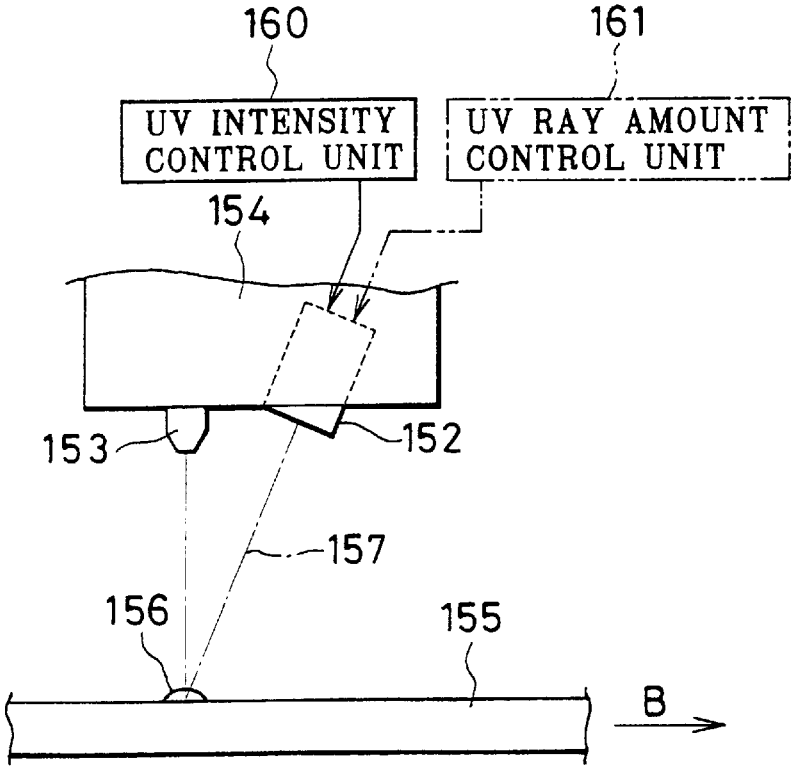
FIG. 19 is an explanatory view in elevation, illustrating still another preferred ink jet printer in which an ultraviolet curable type of ink is used.

In FIG. 19, an ink jet printer for use with an ultraviolet curable type of ink. An ultraviolet emitting laser unit (UVL) 152 as ultraviolet ray emitter unit is disposed instead of the IRLDs 130 of FIG. 16, and extends in parallel with an array of nozzles 153 in an ink jet head 154. After recording material 155 is provided with an image by the ink jet head 154, the ultraviolet emitting laser unit 152 is controlled by an ultraviolet intensity adjustor 160 or control unit for intensity of ultraviolet rays 157 according to an ejected amount of an ink droplet 156, which is cured or hardened by the ultraviolet rays 157. This control with the ejected amount is effective in efficiently curing the ink droplet 156. Note that an amount of the ultraviolet rays 157 may be changed instead of the intensity. In FIG. 19, an ultraviolet ray amount adjustor 161 or control unit indicated by the phantom lines changes the amount of the ultraviolet rays 157. Furthermore, the use of the ultraviolet ray amount adjustor 161 may be combined with that of the ultraviolet intensity adjustor 160.

It is to be noted that, a heater device may include a digital micromirror device (DMD), a piezoelectric type of micromirror device (AMA) or the like (not shown) disposed along the arrays of the nozzles of the ink jet head. Ultraviolet rays for heating may be applied to the digital micromirror device (DMD) or the piezoelectric type of micromirror device (AMA), in which micromirrors are tilted to apply ultraviolet rays according to the ejected amounts. Furthermore, an ultraviolet ray emitter unit for emitting ultraviolet rays, instead of the ultraviolet emitting laser unit 152, may be an excimer laser, ultraviolet lamp or the like.

In the above embodiments, the thermal heads or laser diodes are used for applying heat. Alternatively, a heater or drier device may be constituted by a heater unit and a fan, and apply drying air to the recording material in the main scan direction according to the ejected amount. In such a construction, the heater unit includes a great number of heater sections arranged in the main scan direction, and are controlled for heat energy according to ejected amounts associated with heating regions.

In the above embodiments, drive data for heating elements and ray emitting elements are obtained according to ejected amounts. It is to be noted that the term of the ejected amount used herein means an amount of an ink volatile component included in ejected ink in addition to the ejected amount in a proper meaning. The ink volatile component amount is regarded as ejected amount so as to effect operation of drying ink with high precision without irregularity. Furthermore, the term of the ejected amount used herein also means conversion data of various types which are determined according to image data. This is because the image data is a factor determining the ejected amount in its proper meaning.

In the above embodiment, piezoelectric elements are used in the ink jet heads. However, other types of structures for ejecting ink may be used as ink jet printing. For example, a flow rate control diaphragm type may be used, in which piezoelectric elements are combined with diaphragms. A thermal ink jet printing may be used, in which heating elements heat liquid ink, generate bubbles and eject the ink. A continuous ink jet printing may be used, in which ink droplets are charged by means of electrodes, and deflection electrodes and separator plates are combined to eliminate and withdraw unnecessary ink droplets, and remaining ink droplets are ejected to the recording material. An electrostatic attraction ink jet printing may be used, in which high voltage is applied according to an image signal, and causes attraction of ink droplets to recording material. An ultrasonic ink jet printing may be used, in which ultrasonic waves are applied to vibrate liquid ink, and generate ink droplets. Furthermore, the colors of ink may be light magenta, light cyan and the like instead of the yellow, magenta, cyan and black colors.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. An ink jet printer, comprising:

at least one ink jet head, including plural nozzles arranged in a main scan direction, for ejecting a droplet of ink to recording material respectively at an ejected amount according to information of an image;

moving means for feeding one of said recording material and said inkjet head in a sub scan direction relative to a remaining one thereof, to print said image to said recording material two-dimensionally;

at least one heater, including plural heater sections arranged in said main scan direction, controllable in heat quantity individually, for applying heat to said recording material respectively in a heating region, wherein one heater section of said plural heater sections is provided for said plural nozzles and said heater and said inkjet head being positioned on a same side of the recording material and plural heaters being positioned upstream from respective plural nozzles in an alternative manner; and a controller for driving said heater sections individually according to said ejected amount for said heating region, to promote drying of said droplet in said heating region by controlling said heat quantity for said heating region.

2. An ink jet printer as defined in claim 1, wherein said heater is operated before, during or after operation of said ink jet head.

3. An ink jet printer as defined in claim 2, wherein said controller determines said heat quantity high according to highness in said ejected amount.

4. An ink jet printer as defined in claim 3, wherein said moving means feeds said recording material in said sub scan direction.

5. An ink jet printer as defined in claim 4, wherein said heater is disposed upstream from said ink jet head with reference to feeding of said recording material, and before said ink jet head operates, preheats said heating region where said droplet is ready to deposit.

6. An ink jet printer as defined in claim 4, wherein said heater is disposed downstream from said ink jet head with reference to feeding of said recording material, and heats said droplet ejected by said ink jet head.

7. An ink jet printer as defined in claim 4, wherein said heater heats said droplet simultaneously with ejection by said ink jet head.

8. An ink jet printer as defined in claim 7, wherein said heater is disposed close to said ink jet head with an inclination.

9. An ink jet printer as defined in claim 4, further comprising a speed signal generator for generating a signal of a feeding speed at which said moving means feeds said recording material;

wherein said controller controls said heat quantity further in consideration of said feeding speed.

10. An ink jet printer as defined in claim 4, further comprising an information input unit for inputting information of a recording material width of said recording material in said main scan direction;

wherein said controller designates heater sections to be driven among said heater sections in consideration of said recording material width.

11. An ink jet printer as defined in claim 4, wherein said controller, if said ejected amount is equal to or lower than one reference amount, determines said heat quantity as zero, and if said ejected amount is higher than said reference amount, determines said heat quantity according to said ejected amount.

12. An ink jet printer as defined in claim 3, wherein said heater comprises a thermal head, said plural heater sections are constituted by plural heating elements for pressurizing and heating said recording material.

13. An ink jet printer as defined in claim 12, further comprising a head shifter for shifting said thermal head between a contact position and a non-contact position, wherein said thermal head, when in said contact position, contacts said recording material and is operated, and when in said non-contact position, is away from said recording material.

14. An ink jet printer as defined in claim 3, wherein said heater is disposed beside said ink jet head, and directed to a recording surface where said droplet is ready to deposit.

15. An ink jet printer as defined in claim 3, wherein said plural heater sections are constituted by plural infrared ray emitting elements for applying infrared rays to said heating region.

16. An ink jet printer as defined in claim 3, further comprising an information input unit for inputting at least one of environmental temperature information, type information of said recording material, and thickness information of said recording material;

wherein said controller controls said heat quantity further in consideration of at least one of said environmental temperature information, said type information and said thickness information.

17. An ink jet printer as defined in claim 1, wherein said plural heater sections and said plural nozzles are positioned on a same side of the recording material.

18. An ink jet printer as defined in claim 1, further comprising:

an image processor which receives image data;

a recording data convertor which obtains recording data according to the image data of the image processing;

a look up table (LUT) for storing a relationship between a total ejected amount and a preheating data; and a heating pattern processor for determining the preheating data for said plural heater sections from said total ejected amount by referring to said LUT after determining said total ejected amount for said heating region according to the image data.

19. An ink jet printer as defined in claim 18, wherein the preheating data is sent to a head driver which drives the plural heater sections according to the preheating data in synchronism with feeding of the recording material in order to preheat the recording material before ejection of the droplet of ink.

20. An ink jet printer as defined in claim 18, wherein the heating pattern processor determines preheating data according to drive data from the head driver.

21. An ink jet printer as defined in claim 18, wherein the preheating data is determined according to an amount of a volatile component of the ejected amount.

22. An ink jet printer as defined in claim 18, wherein the preheating data is determined according to image data without obtaining an ejected amount of the droplet of ink based on a known relationship between the ejected amount and the image data.

23. An ink jet printer, comprising:

at least one ink jet head, including plural nozzles arranged in a main scan direction, for ejecting a droplet of ink to recording material respectively at an ejected amount according to information of an image, said ink jet head printing said image at a printing width of at least 80 mm in said main scan direction;

moving means for feeding one of said recording material and said inkjet head in a sub scan direction relative to a remaining one thereof to print said image to said recording material two-dimensionally said moving means fees said recording material at a feeding speed of at least 20 mm per second in said sub scan direction;

at least one heater, including plural heater sections arranged in said main scan direction, controllable in heat quantity individually, for applying heat to said recording material respectively in a heating region, wherein one heater section of said plural heater sections is provided for said plural nozzles and said heater and said ink jet head being positioned on a same side of the recording material, said heater being operated before, during or after operation of said inkjet head; and a controller for driving said heater sections individually according to said ejected amount for said heating region, to promote drying of said droplet in said heating region by controlling said heat quantity for said heating region, said controller further deter said heat quantity high according to highness in said ejected amount.

24. All inkjet printer, comprising:

at leg one ink jet head, including plural nozzles arranged in a main scan direction, for ejecting a droplet of ink to recording material respectively at an ejected amount according to information of an image;

a head carriage for feeding said ink jet head in a sub scan direction relative to said recording material, to effect belt-shaped printing of said image;

a moving mechanism for moving one of said recording material and said head carriage relative to a remaining one thereof in said main scan direction by an amount of said belt-shaped printing, to print said image in a frame printing manner;

at least one heater, including plural heater sections arranged in said main scan direction, controllable in heat quantity individually, for applying heat to said recording material respectively in a heating region, one heater section of said plural heater sections being provided for said plural nozzles and said heater and said ink jet head being positioned on a same side of the recording material, and plural heaters are positioned upstream from respective plural nozzles in an alternative manner; and a controller for driving said heater sections individually according to said ejected amount for said heating region, to promote drying of said droplet in said heating region by controlling said heat quantity for said heating region.

25. An ink jet printer as defined in claim 24, wherein said heater is secured to said head carriage beside said ink jet head.

26. An ink jet printer as defined in claim 25, wherein said heater is disposed downstream from said ink jet head with reference to feeding of said head carriage, and before said ink jet head operates, preheats said heating region where said droplet is ready to deposit.

27. An ink jet printing method comprising:

a step of ejecting a droplet of ink to recording material through plural nozzles respectively at an ejected amount according to information of an image, said plural nozzles being arranged in a main scan direction, for constituting an ink jet head;

a step of feeding one of said recording material and said ink jet head in a sub scan direction relative to a remaining one thereof, to print said image to said recording material two-dimensionally;

a step of determining drying heat energy according to said ejected amount for a heating region defined on said recording material and arranged in said main scan direction; and a step of applying said drying heat energy to said heating region on a same side of the recording material as the ejected amount, to promote drying of said droplet in said heating region.

28. An ink jet printing method as defined in claim 27, wherein said energy determining step determines said drying heat energy high according to highness in said ejected amount.

29. An ink jet printing method as defined in claim 28, wherein before said ejecting step, said heat applying step preheats said heating region where said droplet is ready to deposit, on an upstream side from said ink jet head with reference to feeding of said recording material.

30. An ink jet printing method as defined in claim 28, wherein after said ejecting step, said heat applying step heats said droplet on a downstream side from said ink jet head with reference to feeding of said recording material.

31. An ink jet printing method as defined in claim 28, wherein said heat applying step includes using plural heating elements arranged in said main scan direction, for respectively pressurizing and heating said recording material.

32. An inkjet printer, comprising at least one inkjet head, including plural nozzles arranged in a main scan direction, for ejecting a droplet of ink to recording material respectively at an ejected amount according to information of an image, said ink jet head printing said image at a printing width of at least 80 mm in said main scan direction;

moving means for feeding one of said recording material and said inkjet head in a sub scan direction relative to a remaining one thereof, to print said image to said recording material two-dimensionally;

at least one heater, including plural heater sections arranged in said main scan direction, controllable in heat quantity individually, for applying heat to said recording material respectively in a heating region, wherein one heater section of said plural heater sections is provided for said plural nozzles and said heater and said inkjet head being positioned on a same side of the recording material, said heater being operated before, during or after operation of said inkjet head; and a controller for driving said heater sections individually according to said ejected amount for said heating region, to promote dying of said droplet in said heating region by controlling said heat quantity for said heating region, said controller further determining said beat quantity high according to highness in said ejected amount, wherein the plural heaters are positioned upstream from respective plural nozzles in an alternative manner.

* * * * *

UNITED STATES PATENT AND TRADEMARK OFFICE

CERTIFICATE OF CORRECTION

PATENT NO. : 6,523,948 B2
DATED : February 25, 2003
INVENTOR(S) : Nobuo Matsumoto et al.

It is certified that error appears in the above-identified patent and that said Letters Patent is hereby corrected as shown below:

Column 18,
Line 2, change “deter” to -- determining --.
Line 4, change “All” to -- An --.
Line 5, change “leg” to -- least --.

Column 20,
Line 12, change “dying” to -- drying --.
Line 14, change “beat” to -- heat --.

Signed and Sealed this

Eighth Day of April, 2003

JAMES E. ROGAN
*Director of the United States Patent and Trademark Office*